US006520739B2

(12) United States Patent
Tsuji

(10) Patent No.: US 6,520,739 B2
(45) Date of Patent: Feb. 18, 2003

(54) CEILING FAN WITH LIGHT ASSEMBLY

(75) Inventor: Masao Tsuji, Germantown, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 09/882,432

(22) Filed: Jun. 18, 2001

(65) Prior Publication Data

US 2002/0192077 A1 Dec. 19, 2002

(51) Int. Cl.[7] ..... F04D 29/00
(52) U.S. Cl. ..... 416/5; 416/244 R
(58) Field of Search ..... 416/244 R, 5; 362/96, 404, 234, 241, 245, 246

(56) References Cited

U.S. PATENT DOCUMENTS 4,382,400 A * 5/1983 Stutzman ..... 362/294
6,019,577 A 2/2000 Dye ..... 416/2
6,302,556 B1 * 10/2001 Filip ..... 362/404

* cited by examiner

*Primary Examiner*—Edward K. Look
*Assistant Examiner*—Dwayne J. White
(74) *Attorney, Agent, or Firm*—Baker, Donelson, Bearman & Caldwell

(57) ABSTRACT

A ceiling fan (10) is disclosed having a downrod (11), a motor (12), a radial array of fan blades (13) coupled to blade irons (14) mounted to the motor (12), a bowl shaped lower housing (17) positioned above the blade irons (14), a bowl shaped upper housing (18) positioned concentrically within the lower housing (17), and an upper light assembly (21) positioned within the upper housing (18) having an annular array of light bulbs (23). The upper housing (18) has an annular array of openings (26) in which are mounted translucent windows (27). The opening (26) and corresponding window (27) are mounted generally between each pair of adjacent light bulbs (23).

6 Claims, 2 Drawing Sheets

CEILING FAN WITH LIGHT ASSEMBLY

TECHNICAL FIELD

This invention relates generally to ceiling fans, and more particularly to ceiling fans having light assemblies.

BACKGROUND OF THE INVENTION

Ceiling fans having a number of motorized rotating blades have existed for many years. Many of today's ceiling fans include a light assembly which may be used in the place of a light fixture mounted to the ceiling. These light assemblies typically are mounted to the bottom of the ceiling fan below the plane of rotation of the fan blades.

The positioning of the light assembly below the rotating blades however causes a strobe like effect upon the ceiling. This strobe effect is caused by the light passing from the light assembly and through the rotating blade before it illuminates the ceiling, thereby causing the blade to cast a momentary shadow upon the ceiling.

Light assemblies have also been mounted above the rotating blades of the ceiling fan. Here, however, the downward passage of the light causes a strobe effect throughout the room in which the ceiling fan is mounted, for the light passes through the rotating blades prior to illuminating the room below the ceiling fan.

To reduce the strobe effect problem associated with light assemblies, ceiling fans have also been designed to include both a lower light assembly positioned within a lower housing below the blades and an upper, second light assembly positioned within an upper housing above the blades. The upper light assembly projects light upon the ceiling while the lower light assembly projects light downwardly about the room. However, as these light assemblies are each positioned within housing which prevent the light from passing through the adjacent rotating blades the motor housings of these fans are outside the illumination pattern of either light assembly, and is therefore darkened from view.

To solve this problem a ceiling fan has been designed which includes a third light assembly positioned outside the upper housing and above the lower light assembly, as shown in U.S. Pat. No. 6,019,577. The ceiling fan also includes a shield positioned below the third light assembly which prevents light emanating from the third light assembly from passing through the rotating blades. The costs associated with this type of ceiling fan however increases due to the inclusion of the third lighting assembly and shields. Furthermore, as the third light assembly is positioned closely adjacent the upper housing the light therefrom appears concentrated upon the upper housing directly adjacent the third light source, giving the upper housing an uneven lit appearance.

Ceiling fans have also been provided with translucent housings through which the light passes. These housings however typically allow a large amount of the light to pass through the housing, thereby once again creating a strobe effect beneath the ceiling fan. Another problem associated with these fan housings is that the light bulb positioned behind the translucent housing creates an area of high light intensity or bright spot. The appearance of these bright spots upon the housing are distracting and undesired.

Accordingly, it is seen that a need remains for a ceiling fan having a lighting assembly which does not create a strobe effect nor an uneven light intensity upon a translucent housing, but which also provides a unique lighting effect. It is to the provision of such therefore that the present invention is primarily directed.

SUMMARY OF THE INVENTION

In a preferred form of the invention a ceiling fan comprises an electric motor, a plurality of blades coupled to the motor, a housing having an annular array of openings each having a translucent window therein, and an annular array of light sources mounted within the housing. Each light source is positioned between two adjacent housing openings. With this construction, light emanating from each light source is directed through the opening at an acute angle to prevent the light source from being easily discerned th rough the window.

DETAILED DESCRIPTION

Figure 1:
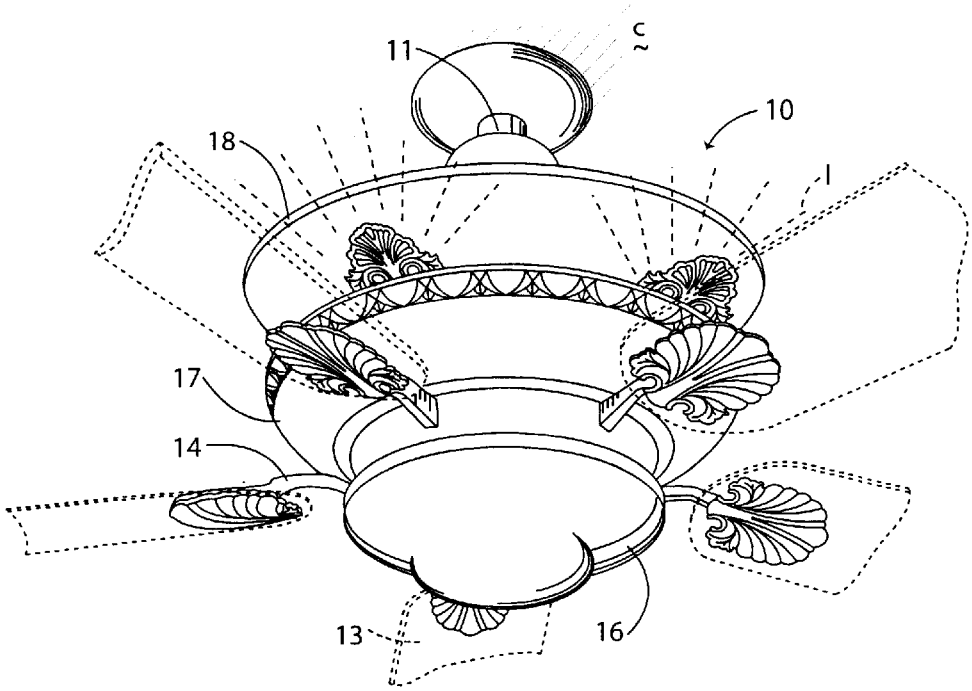
FIG. 1 is a perspective view of a ceiling fan embodying principles of the invention in a preferred form.
Figure 2:
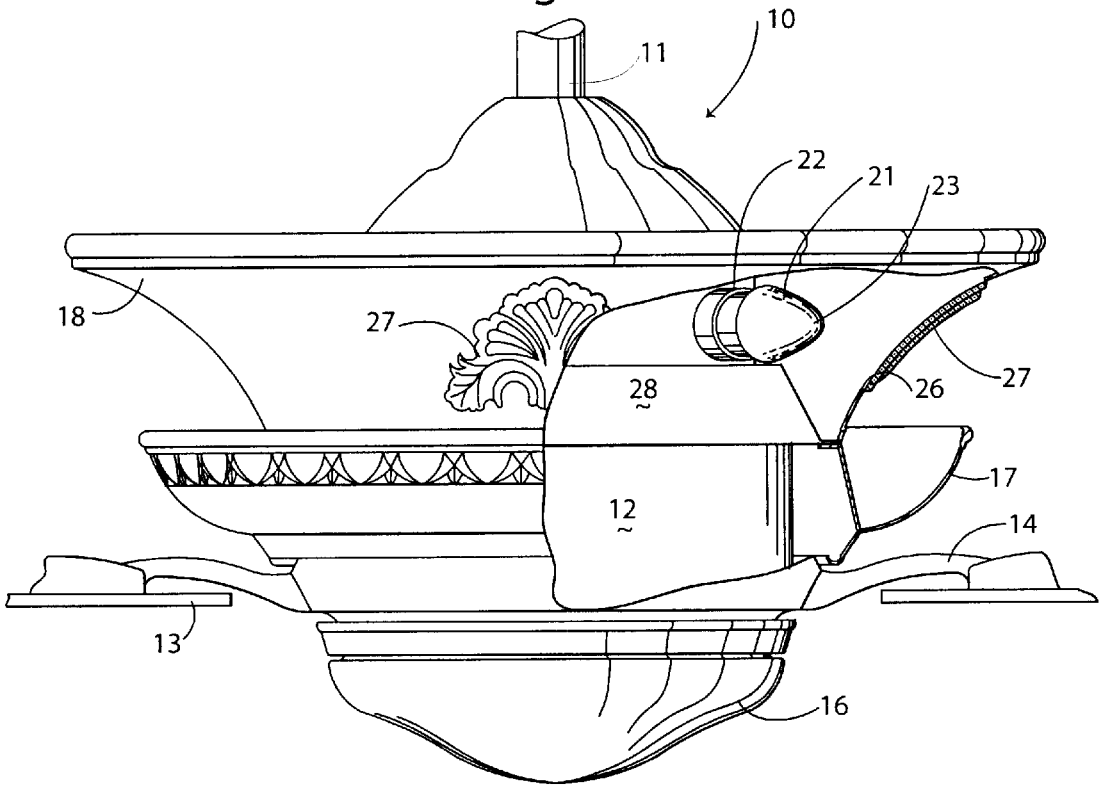
FIG. 2 is a side view, in partial cross-section, of the ceiling fan of FIG. 1.

With reference next to the drawings, there is shown a ceiling fan 10 suspended from a ceiling c in a preferred form of the invention. The ceiling fan 10 has a downrod 11 coupled to the top of a motor 12 to which is mounted a radial array of fan blades 13 through corresponding blade irons 14. The ceiling fan 10 also has a lower light assembly 16 positioned below the motor 12 and blade irons 14, a bowl shaped lower housing 17 positioned above the blade irons 14, and a bowl shaped upper housing 18. Lastly, an upper light assembly 21 having an annular array of four incandescent light bulb housings 22 and incandescent light bulbs 23 is positioned concentrically within the upper housing 18.

The motor 12 extends through an opening at the lower end of the lower housing 17. The blade irons 14 are coupled to the motor 12 at predetermined locations depending on the desired number of fan blades 13. Although the fan is shown in the preferred embodiment with five blades, any number of fan blades may be used as dictated by convention. Thus, rotational motion produced by the motor 12 will produce air circulation through rotational movement of the fan blades 13.

The upper housing 18 has an annular array of openings 26 therethrough. A translucent window 27, in the form of a medallion, is mounted within each opening 26. The openings 26 and corresponding windows 27 are positioned generally between each pair of adjacent light bulbs 23, and as such each light bulb is positioned between two adjacent windows. The upper housing 18 may also include an inner liner 28 having a light reflective quality so that light 1 radiating from the upper light assembly 21 may be reflected off the inner liner 28 indirectly back through the opening 26 or upwardly towards the ceiling c. Likewise, the interior of the upper housing may also have a light reflective quality to further diffuse light prior to being radiated upwardly or through the openings.

In order to control the speed of rotation of the fan blades 13 the motor 12 has an unshown control switch which can be controlled conventionally through actuation of a pull string or electrical controller. Also, the upper and lower light assemblies 21 and 16 may be controlled through a unshown, conventional control switch.

Figure 3:
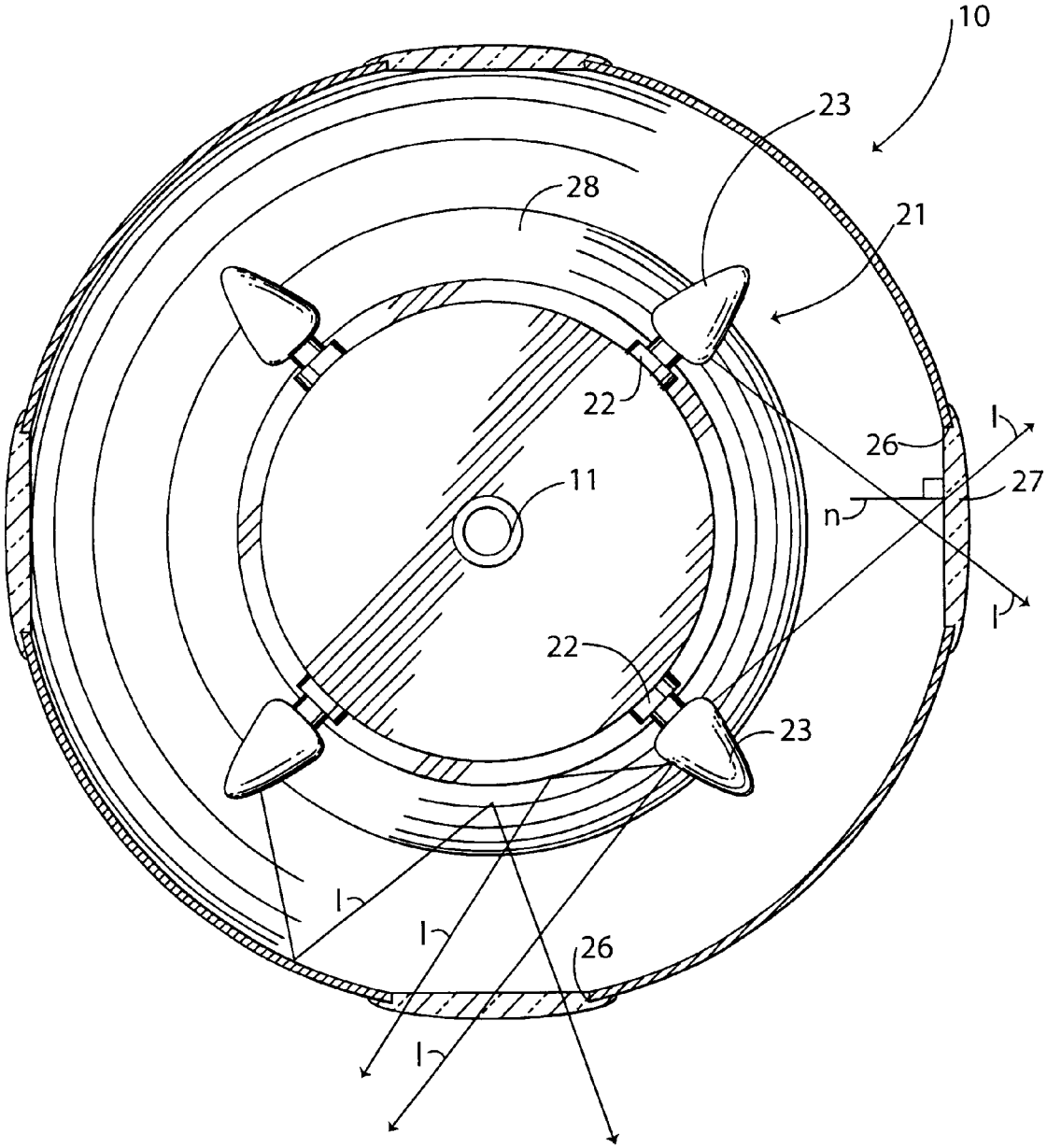
FIG. 3 is a cross-sectional top view of the ceiling fan of FIG. 1.

In use, light from the lower light assembly 16 radiates downwardly so as to illuminate the room in which the ceiling fan is mounted. A portion of the light 1 from the upper light assembly 21 radiates upwardly to illuminate the ceiling c while other portions of the light 1 pass directly from the upper light assembly 21 or indirectly from the inner liner 28 through the upper housing openings 26 and onto the translucent windows 27 so as to illuminate the window 27. The reflection of the light from the interior surface of the housing and from the inner liner 28 creates a diffused bath of light passing through the window rather than an intense concentration of light in one area directly behind the window, a problem associated with the prior art wherein the placing of a bulb directly behind a translucent housing caused a bright spot to appear. This bath of light passing through the window from the offset positioning of the bulb from a line a sight generally normal to the window, indicated as n in FIG. 3, causes the light to be directed at an acute angle onto the inward surface of the window, thus creating an even and visual appealing illumination of the window.

It should be understood that other conventional types of lights may be used as an alternative to the annular array lighting shown as the upper light assembly in the preferred embodiment.

It should also be understood that the translucent window may be made of glass, plastic, crystal, mica or the like. All these materials provide a benefit of diffusing the light from the upper light assembly.

It thus is seen that a ceiling fan having lighting capabilities is now provided which overcomes problems with those of the prior art. While this invention has been described in detail with particular references to the preferred embodiments thereof, it should be understood that many modifications, additions and deletions, in addition to those expressly recited, may be made thereto without departure from the spirit and scope of the invention as set forth in the following claims.

I claim:

1. A ceiling fan comprising:

an electric motor;

a plurality of blades coupled to said motor;

a housing having an annular array of openings, each said opening having a translucent window therein, and an annular array of light sources mounted within said housing, each said light source being positioned between two adjacent said housing openings, whereby light emanating from each light source is directed through the opening at an acute angle to prevent the light source from being easily discerned through the window.

2. The ceiling fan of claim 1 further comprising a light reflector positioned within said housing to reflect light from said light sources through said openings.

3. The ceiling fan of claim 1 wherein said window diffuses light passing therethrough.

4. A ceiling fan comprising:

an electric motor;

a plurality of blades coupled to said motor;

a housing having a plurality of openings therethrough;

a light diffusing member associated with each said opening within said upper housing, and light producing means for producing visible light, said light producing means being mounted offset from a direct line of sight through and generally normal to said light diffusing member, whereby light passing through the light diffuser is directed onto the light diffuser from the light producing means at an acute angle to prevent the light producing means from being discerned through the light diffusing member.

5. The ceiling fan of claim 4 wherein said light diffusing member is a translucent window.

6. The ceiling fan of claim 4 further comprising a light reflector positioned within said housing to reflect light from said light sources through said openings.

* * * * *